US006492795B2

(12) United States Patent
Engl

(10) Patent No.: US 6,492,795 B2
(45) Date of Patent: Dec. 10, 2002

(54) REFERENCE CURRENT SOURCE HAVING MOS TRANSISTORS

(75) Inventor: Bernhard Engl, Miesbach (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/943,591

(22) Filed: Aug. 30, 2001

(65) Prior Publication Data

US 2002/0109490 A1 Aug. 15, 2002

(30) Foreign Application Priority Data

Aug. 30, 2000 (DE) ..... 100 42 586

(51) Int. Cl.[7] ..... G05F 3/04
(52) U.S. Cl. ..... 323/312; 323/907
(58) Field of Search ..... 323/311, 312, 323/313, 314, 315, 907

(56) References Cited

U.S. PATENT DOCUMENTS 4,335,346 A * 6/1982 Streit ..... 323/313
5,153,499 A * 10/1992 Klesh ..... 323/280
5,204,612 A * 4/1993 Lingstaedt ..... 323/317
5,587,655 A * 12/1996 Oyabe et al. ..... 323/312
5,672,961 A * 9/1997 Entrinkin et al. ..... 323/315
6,348,780 B1 * 2/2002 Grant ..... 323/222

FOREIGN PATENT DOCUMENTS

DE 33 29 664 A1 3/1985
DE 32 40 958 C2 7/1990

* cited by examiner

*Primary Examiner*—Adolf Deneke Berhane
(74) *Attorney, Agent, or Firm*—Laurence A. Greenberg; Werner H. Stemer; Gregory L. Mayback

(57) ABSTRACT

A reference current source includes at least one first voltage-controlled current source, at least one second voltage-controlled current source, and an addition unit. The first voltage-controlled current source includes: at least one first control voltage source providing a first temperature-dependent control voltage, at least one first MOS transistor having a process gain, and an output providing a first current that is dependent on the control voltage and on the process gain of the first MOS transistor. The second voltage-controlled current source includes: at least one second control voltage source providing a second control voltage, at least one second MOS transistor having a process gain, and an output providing a second current that is dependent on the second control voltage and on the process gain of the second MOS transistor. The addition unit provides a reference current from the first current and the second current.

11 Claims, 5 Drawing Sheets

$$A = \frac{1}{2} \cdot \frac{W1}{L1} \cdot \frac{1}{\left(\sqrt{\frac{W1 \cdot L2}{L1 \cdot W2}} - 1\right)^2}$$

REFERENCE CURRENT SOURCE HAVING MOS TRANSISTORS

BACKGROUND OF THE INVENTION

Field of the Invention

The present invention relates to a reference current source for providing a current that is at least approximately temperature-independent within a temperature interval.

A known circuit for generating a temperature-independent current has a bandgap reference, as is described for example in Tietze, Schenk: "Halbleiterschaltungstechnik" [Semiconductor circuitry], Springer Verlag, Berlin, 1991, page 558, and a largely temperature-stable resistor. In this case, the resistor is connected to an output of the bandgap reference at which a temperature-independent output voltage is present, and a temperature-independent current flows through said resistor, which current can be fed to an application circuit via a simple current mirror circuit.

Problems can arise through the use of a bandgap reference and a resistor for reference current generation in integrated circuits using CMOS technology. In CMOS technology, resistors can be fabricated with the required accuracy only with very great difficulty. Moreover, the resistances of such resistors are greatly dependent on temperature.

U.S. Pat. No. 4,843,265 discloses using a MOS transistor for generating a reference current. For compensation of a temperature dependence of the drain-source current of a MOS transistor, in the known reference current source a circuit arrangement is connected to the gate terminal, which circuit arrangement generates a control voltage which is dependent on absolute temperature and counteracts the temperature drift of the drain-source current.

An approach similar to that in U.S. Pat. No. 4,843,265 is pursued in the case of a known reference current source according to Blauschild: "An Integrated Time Reference", 1994, International Solid State Circuits Conference, Paper WP3.5.

In the case of the current source both according to U.S. Pat. No. 4,843,265 and according to Blauschild, good bipolar transistors are necessary in order to generate a drive voltage which counteracts the temperature drift of the drain current. Although parasitic bipolar transistors are available in all bulk CMOS processes, their electrical properties allow reproducibility to an ever poorer extent in CMOS processes, particularly in the "Deep-Submicron" range.

It is an aim of the present invention to provide a reference current source which supplies an at least approximately constant current within a temperature interval and which can be realized simply and cost-effectively using CMOS technology.

SUMMARY OF THE INVENTION

The reference current source according to the invention has a first voltage-controlled current source having at least one first control voltage source for providing a first temperature-dependent control voltage and having at least one first MOS transistor. In this case, a first current is available at an output of the first voltage-controlled current source, which current is dependent on the control voltage and a process gain of the at least one first MOS transistor. The reference current source furthermore has a second voltage-controlled current source having at least one second control voltage source for providing a second control voltage and having at least one second MOS transistor. In this case, a second current is available at an output of the second voltage-controlled current source, which current is dependent on the second control voltage and a process gain of the at least one second MOS transistor. Furthermore, an addition unit is provided for the purpose of forming a reference current from the first and second currents of the first and second current sources. The process gain K of a MOS transistor results, as is known, from the product of the temperature-dependent charge carrier mobility $\mu$ and a capacitance per unit length Cox, which is dependent, inter alia, on the thickness of the gate oxide. In the case of the reference current source according to the invention, in which the first current is dependent on the temperature-dependent first control voltage and the temperature-dependent process gain K, and in which the second current is dependent on the temperature-dependent process gain and the second control voltage, the first and second currents can be set by means of suitable dimensioning of the MOS transistors in the current sources or by means of suitable weighting of the currents prior to their addition in such a way that the reference current resulting from the first and second currents is at least approximately temperature-independent within a temperature interval.

The first control voltage, which is dependent on temperature and is preferably proportional to absolute temperature, can be generated with sufficient accuracy by a bipolar transistor, in particular by a parasitic bipolar transistor present in every bulk CMOS circuit.

The second control voltage is configured in particular in such a way that the derivative of the first control voltage with respect to temperature and the derivative of the second control voltage with respect to temperature are not identical. The second control voltage is preferably constant within the relevant temperature interval within which the reference current is intended to be constant, or, within this interval, is inversely proportional to absolute temperature.

The current supplied by the first and second voltage-controlled current sources preferably satisfies the following relationship:

$$I K \cdot Uc^2 \quad (1)$$

where I designates the respective output current of the first or second current source and Uc designates the respective control voltage.

W. M. Sansen et al.: "A CMOS Temperature-Compensated Current Reference", IEEE Journal of Solid State Circuits, vol. 23, No. 3, June 1988, describe the basic construction of an exemplary embodiment of a current source whose output current satisfies the relationship (1). The circuit arrangement essentially has two MOS transistors whose control terminals are coupled by means of a control voltage source and through which the current I flows in each case.

A proportionality factor A not contained in equation (1) is dependent on the dimensioning of the two MOS transistors in each voltage-controlled current source. Mathematically, it can be shown that the output currents of the first and second voltage-controlled current sources can be weighted by means of suitable dimensioning of the two MOS transistors or by means of multiplication of the output currents by suitable weighting factors prior to addition in such a way that the reference current is at least approximately temperature-independent.

DESCRIPTION OF THE PREFERRED EMBODIMENTS

In the figures, unless specified otherwise, identical reference symbols designate identical parts with the same meaning.

Figure 1:
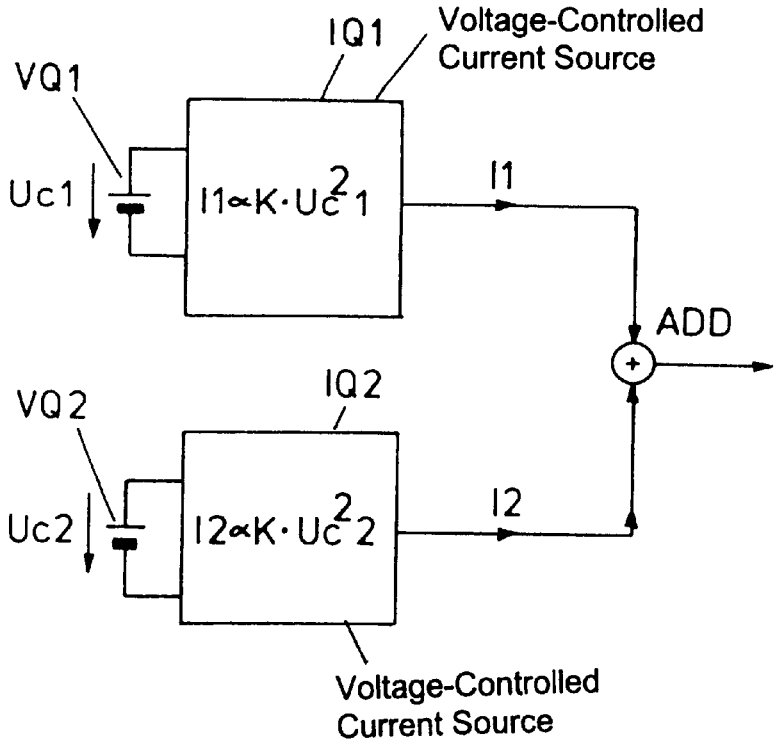
FIG. 1 shows a block diagram of a reference current source according to the invention with a first and a second voltage-controlled current source and an addition unit.

FIG. 1 shows a block diagram of a reference current source according to the invention, which has a first voltage-controlled current source IQ1 for providing a first current I1 and a second voltage-controlled current source IQ2 for providing a second current I2, An addition unit ADD combines the first and second currents I1, I2 to form a reference current Iref. The first current source IQ1 has a first control voltage source UQ1 for providing a first control voltage Uc1, which is temperature-dependent and preferably proportional to absolute temperature T. The second current source IQ2 has a second control voltage source UQ2 for providing a second control voltage Uc2, The second control voltage Uc2 is preferably temperature-independent or inversely proportional to absolute temperature.

Each of the current sources IQ1, IQ2 has at least one MOS transistor. The output currents I1, I2 of the first and second current sources IQ1, IQ2 are preferably proportional to the product of the process gain K of the respective MOS transistor and the square of the respective control voltage Uc1, Uc2, The process gain K results from the product of the temperature-dependent charge carrier mobility p and the capacitance per unit length Cox of the gate capacitance. For the exemplary embodiments, it is assumed that the MOS transistors in the current sources IQ1, IQ2 have been produced by the same fabrication process, so that the process gain K is identical for both current sources IQ1, IQ2.

Figure 2:
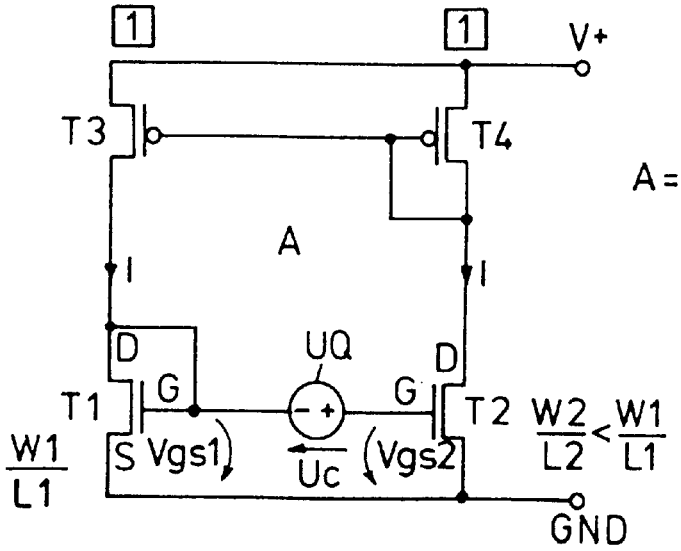
FIG. 2 shows a circuit diagram of a first or second voltage-controlled current source in accordance with a first embodiment.

FIG. 2 shows an exemplary embodiment of a realization of one of the current sources IQ1, IQ2, The circuit arrangement has a first and a second MOS transistor T1, T2, between whose gate terminals G a control voltage source UQ for providing a control voltage Uc is connected in order to couple the gate terminals to one another. In this case, the drain terminal D of the first transistor T1 is connected to the gate terminal G thereof. The ratio W1/L1 of channel width to channel length of the first transistor T1 is greater than the ratio W2/L2 of channel width to channel length of the second transistor T2.

A complementary third transistor T3 (p-channel transistor) is connected in series with the first transistor T1 (n-channel transistor) and a complementary fourth transistor T4 (p-channel transistor) is connected in series with the second transistor T2 (n-channel transistor), the third and fourth transistors T3, T4 being connected up as a current mirror, that is to say their gate terminals are connected to one another and the drain terminal of the fourth transistor T4 is connected to the gate terminal thereof. The series circuits comprising the first and third transistors T1, T3 and the second and fourth transistors T2, T4 are in each case connected up between a terminal for a supply potential V+ and a terminal for a reference-ground potential GND. The transfer ratio of the current mirror T3, T4 is 1:1, in other words a current I of the same magnitude flows through the two transistors. This can be achieved by means of identically dimensioned transistors T3, T4 through which the same drain-source current flows for a given gate-source voltage.

Without adversely affecting the functioning of the circuit arrangement, the n-channel transistors can, of course, be replaced by p-channel transistors, and vice versa, in which case the polarity of the supply voltage should then be reversed.

In accordance with a known model for the transfer response of a MOS transistor, the current I through the first MOS transistor T1 satisfies the following relationship:

$$I = \frac{K}{2} \cdot \frac{W1}{L1} \cdot (Vgs1 - Vth)^2 \tag{2}$$

The following correspondingly holds true for the current I2 through the second transistor T2:

$$I = \frac{K}{2} \cdot \frac{W2}{L2} \cdot (Vgs2 - Vth)^2 \tag{3}$$

where

K is the temperature-dependent process gain of the MOS transistors T1, T2, Vgs1, Vgs2 is the respective gate-source voltage of the MOS transistors T1, T2, and Vth is the so-called threshold voltage of the MOS transistors.

If the circuit in accordance with FIG. 2 is analyzed using equations (2) and (3) and if Vgs2=Vgs1+Uc is set, then the following results for the current I dependent on Uc:

$$I = K \cdot Uc^2 \cdot A \tag{4}$$

where the constant proportionality factor A in accordance with $$A = \frac{1}{2} \cdot \frac{W1}{L1} \cdot \frac{1}{\left(\sqrt{\frac{W1 \cdot L2}{L1 \cdot W2}} - 1\right)^2} \tag{5}$$

is dependent on the channel widths W1, W2 and channel lengths L1, L2 of the transistors T1, T2.

The current source according to FIG. 2 generates a current I which is linearly dependent on the temperature-dependent process gain K and quadratically dependent on the control voltage Uc.

As is not specifically illustrated, a current of this type can also be generated by means of a current source whose construction essentially corresponds to the current source according to FIG. 2 and in which the control voltage source is connected up between the source terminal of the first or second transistor T1; T2 and the reference-ground potential.

Figure 3:
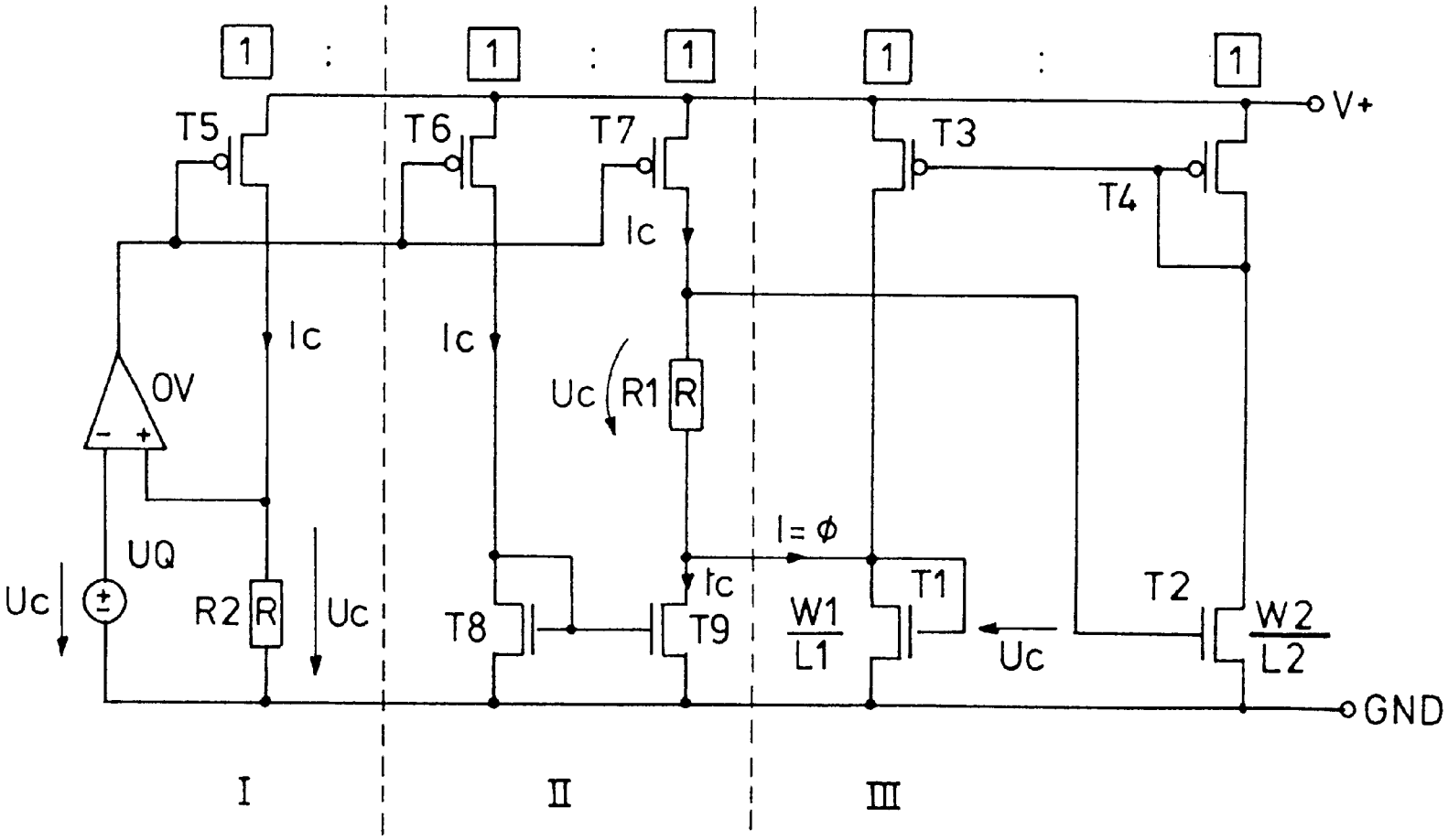
FIG. 3 shows a circuit diagram of a first or second voltage-controlled current source in accordance with a second embodiment.

In the current source according to FIG. 2, the control voltage Uc of the control voltage source must be referred to the changing gate potential of the first transistor T1. FIG. 3 shows an exemplary embodiment of the realization of such a floating voltage source.

The circuit arrangement has a control voltage source UQ, which supplies a control voltage Uc referred to reference-ground potential GND. This control voltage is transferred by a suitable circuit arrangement to a resistor R1 connected up between the gate terminals of the first and second transistors. In this case, the voltage source UQ is connected up between a first terminal (inverting terminal) of an operational amplifier OV and the reference-ground potential GND. A second terminal of the operational amplifier OV is connected to a terminal of a second resistor R2, whose other terminal is connected to reference-ground potential GND and which has at least approximately the same resistance R as the first resistor R1. Connected in series with the resistor R2 is a transistor T5 (p-channel MOS transistor), whose drain terminal is connected to the resistor R2 and whose source terminal is connected to the supply potential V+. The gate terminal of the transistor T5 is connected to the output of the operational amplifier OV.

The operational amplifier OV regulates the transistor T5 in such a way that a current Ic flows through the second resistor R2, which current brings about a voltage drop across said resistor R2 which corresponds to the control voltage Uc. In this case, the resistance R of the second resistor R2 is virtually insignificant. The regulation of the transistor T5 also compensates for temperature-dictated fluctuations in the resistance R, as occur in particular in resistors which are realized using MOS technology.

The circuit arrangement furthermore has a current mirror arrangement having transistors T6 (p-channel transistor) and T8 (n-channel transistor) which are connected up in series between the supply potential V+ and the reference-ground potential GND, and having transistors T7 (p-channel transistor) and T9 (n-channel transistor) which are connected up in series between the supply potential V+ and the reference-ground potential GND. Connected up between the transistors T7 and T9 is the first resistor R1, one of whose terminals is connected to the gate terminal of the first transistor T1 and whose other terminal is connected to the gate terminal of the second transistor T2.

The transistors T6, T7 are likewise driven by the operational amplifier OV, for which purpose their gate terminals are connected to the output terminal of the operational amplifier. The p-channel transistors T5, T6, T7 are preferably dimensioned identically such that there also flows in the two paths of the current mirror T6, T7, T8, T9 a current Ic whose magnitude corresponds to that of the current through the second resistor R2, This current Ic brings about a voltage drop Uc across the first resistor R1 which corresponds to the control voltage Uc of the control voltage source UQ, said voltage Uc now being referred to the gate potential of the first transistor T1 of the current source.

The components according to FIG. 3 are preferably realized in a common semiconductor body by means of the same process steps. The two resistors R1, R2 then have the same temperature response, thereby ensuring that the same current Ic brings about the same voltage Uc across the resistors R1, R2.

Figure 4:
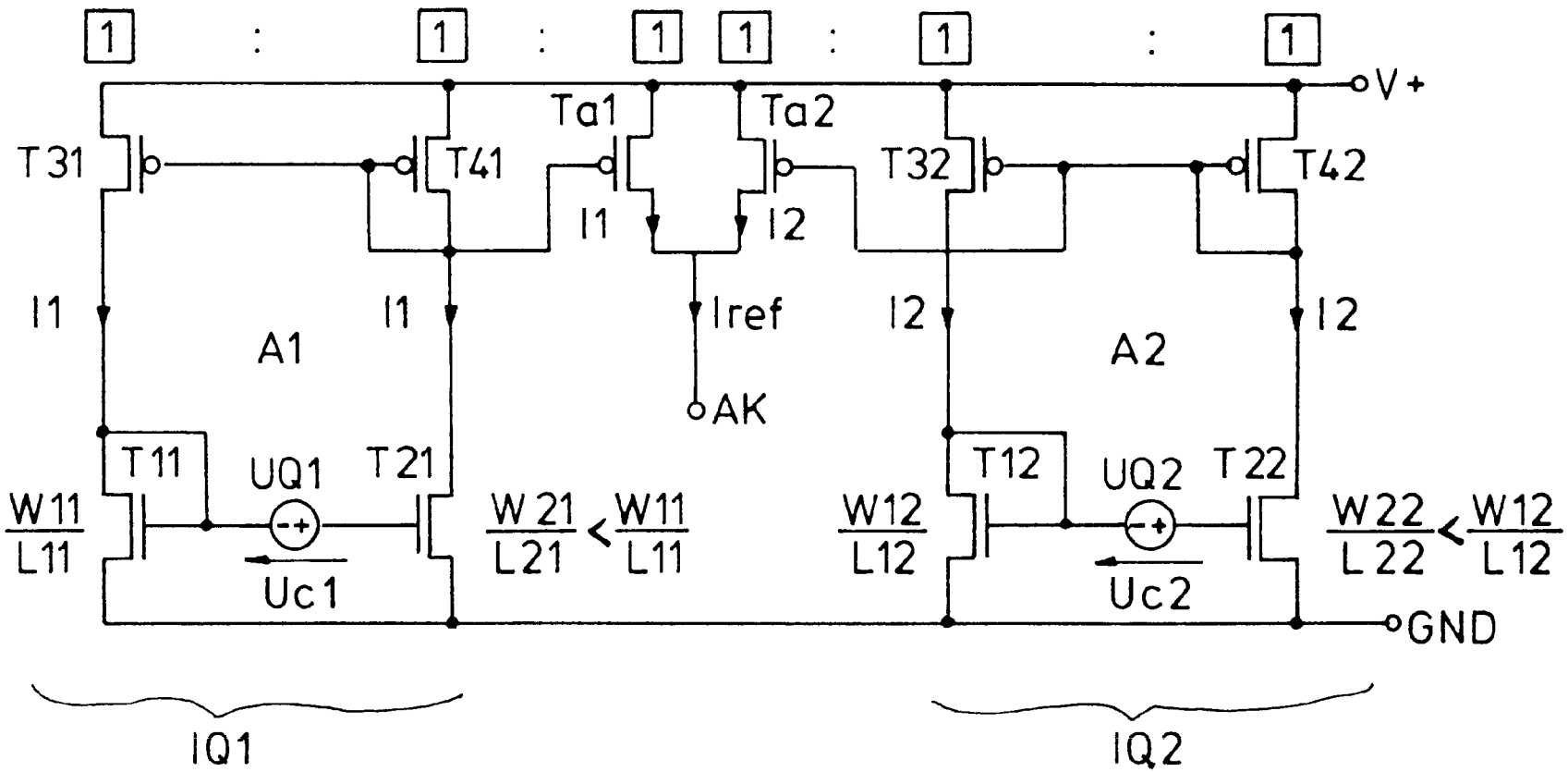
FIG. 4 shows a circuit diagram of a reference current source according to the invention in accordance with a first embodiment.

FIG. 4 shows an exemplary embodiment of a reference current source according to the invention which has a first voltage-controlled current source IQ1 and a second voltage-controlled current source IQ2 whose construction in each case corresponds to the current source explained above according to FIG. 2.

A first transistor T11 of the first current source IQ1 corresponds to the first transistor T1 of the circuit arrangement according to FIG. 2, a second transistor T2 corresponds to the second transistor T2, a third transistor T31 corresponds to the third transistor T3 and a fourth transistor T42 corresponds to the fourth transistor T4, The channel-width-to-channel-length ratio W11/L11 of the first transistor T11 is greater than the channel-width-to-channel-length ratio W21/L21 of the second transistor T21, A first transistor T12 of the second current source IQ2 corresponds to the first transistor T1 of the current source according to FIG. 2, a second transistor T22 corresponds to the second transistor T2, a third transistor T32 corresponds to the third transistor T3 and a fourth transistor T42 corresponds to the fourth transistor T4, The channel-width-to-channel-to-length ratio W12/L12 of the first transistor T12 is greater than the channel-width-to-channel-length ratio W22/L22 of the second transistor T22.

For reasons of clarity, control voltage sources UQ1, UQ2 for providing the control voltages Uc1, Uc2 between the gate terminals of the first and second transistors T11, T21; T12, T22 of the respective current source are illustrated as simple voltage sources. It goes without saying that these voltage sources UQ1, UQ2 can be realized as floating voltage sources in the embodiment in accordance with FIG. 3 or any other embodiment.

A first current I1 flows through the first and second transistors T11, T21 of the first current source, for which current the following holds true in accordance with the equation (4):

$$I1=K\cdot Uc1^2\cdot A1 \tag{6}$$

where the following holds true for the constant proportionality factor A1 in accordance with equation (5):

$$A1=\frac{1}{2}\cdot\frac{W11}{L11}\cdot\frac{1}{\left(\sqrt{\frac{W11\cdot L21}{L11\cdot W21}}-1\right)^2} \tag{7}$$

The following correspondingly holds true for a second current I2, which flows through the first and second transistors T12, T22 of the second current source:

$$I2=K\cdot Uc2^2\cdot A2 \tag{8}$$

where $$A2=\frac{1}{2}\cdot\frac{W12}{L12}\cdot\frac{1}{\left(\sqrt{\frac{W12\cdot L22}{L12\cdot W22}}-1\right)^2} \tag{9}$$

as constant proportionality factor dependent on the dimensioning of the first and second transistors T21, T22 of the second current source.

The reference voltage source has an output stage which, in the simplest case, has two output transistors Ta1, Ta2 (p-channel transistors) and provides a sum of the first and second currents I1, I2 at an output terminal AK for a load. A first output transistor Ta1 is connected up to the fourth transistor T41 of the first current source IQ1 to form a current mirror, in other words its gate terminal is connected to the gate terminal of the fourth transistor T41 and its source terminal is connected to the supply potential. The current ratio of the first output transistor Ta1 and of the fourth transistor T41 of the first current source is 1:1, with the result that the first current I1 likewise flows through the first output transistor Ta1.

In a corresponding manner, a second output transistor Ta2 is connected up to the fourth transistor T42 of the second current source IQ2 to form a current mirror. The ratio of the second output transistor Ta2 and of the fourth transistor T42 of the second current source IQ2 is likewise 1:1, with the result that the current I2 flows through the second output transistor Ta2.

The drain terminals of the first and second output transistors are jointly connected to the output terminal AK. The following then holds true for the reference current available at the output terminal AK:

$$Iref=I1+I2=K\cdot Uc1^2\cdot A1+K\cdot Uc2^2\cdot A2 \tag{10}$$

As explained below, through a suitable choice of the control voltages Uc1, Uc2 and suitable dimensioning of the ratio of A1/A2, it is possible to generate a reference current Iref which is at least approximately constant within a temperature interval.

In accordance with one embodiment of the invention, the first control voltage Uc1 is proportional to absolute temperature (PTAT). The following thus holds true for the first control voltage:

$$Uc1(T)=TC1\cdot T \tag{11}$$

where T is the absolute temperature and TC1 is a temperature coefficient. Such a voltage can be generated in a known manner by means of a bandgap reference and can be applied, for example by means of the arrangement according to FIG. 3, to the gate terminals of the first and second transistors T11, T12 of the first current source IQ1.

The second control voltage is preferably constant or inversely proportional to absolute temperature. It can be generally represented as:

$$Uc2=Uc2(T_R)+TC2\cdot(T-T_R) \tag{12}$$

where $T_R$ is a reference temperature and TC2 is a first-order temperature coefficient referred to said reference temperature. For the special case TC2=0, it is the case that Uc2=Uc2 ($T_R$)=const. Such a constant voltage can be generated by means of a bandgap reference. For the special case TC2<0, the voltage Uc2 is inversely proportional to temperature. Such a voltage can likewise be generated by means of a bandgap reference.

The components of the first and second current sources IQ1, IQ2 are preferably realized in a common semiconductor body and the process gain, dependent on the fabrication, is then at least approximately identical for all of the transistors. The process gain is dependent on the charge carrier mobility $\mu$ and the capacitance per unit length Cox of the gate oxide. It can be represented as:

$$K = K(T_R)\cdot\left(\frac{T}{T_R}\right)^{-\alpha} \tag{13}$$

where $K(T_R)$ designates the process gain at the reference temperature $T_R$. $\alpha$ is a constant dependent on the process for fabricating the MOS transistors. In the case of MOS transistors using silicon technology, $\alpha$ is usually between 1.5 and 1.8.

If the relationships for the first and second control voltages and the process gain are inserted into equation 10, then an expression is obtained for the reference current Iref which is initially dependent on temperature. If the expression obtained is developed into a Taylor series for the reference temperature $T_R$ and if the first-order temperature-dependent term is set to zero, then the following is obtained for the ratio A1/A2:

$$\frac{A1}{A2} = \frac{\alpha\cdot(Uc2(T_R))^2 - 2\cdot Uc2(T_R)\cdot T_R\cdot TC2}{(2-\alpha)\cdot(Uc1(T_R))^2} \tag{14}$$

For the preferred embodiment where Uc2=const, that is to say TC2=0, the following holds true:

$$\frac{A1}{A2} = \frac{\alpha\cdot(Uc2(T_R))^2}{(2-\alpha)\cdot(Uc1(T_R))^2} \tag{15}$$

The control voltages Uc1 ($T_R$), Uc2 ($T_R$) at the reference temperature are preferably identical and are about 0.2V . . . 0.3V. The following then holds true for A1/A12:

$$\frac{A1}{A2} = \frac{1}{\frac{2}{\alpha}-1} \tag{16}$$

The reference temperature lies approximately in the center of the temperature interval within which the reference current is intended to be approximately temperature-independent. Given a ratio A1/A2 which satisfies one of the abovementioned relationships (14) to (16), the reference current Iref does not have a first-order temperature dependence but rather only relatively low higher-order temperature dependencies. The above derivation is based on the simple transistor model in accordance with relationships (2) and (3).

Practical circuit realizations have shown that the reference current of the current source according to the invention is subject at most to fluctuations of 1 . . . 2% in a temperature interval of between 270 K and 330 K, for example, which is sufficient for many applications. Through dimensioning of the first and second transistors T11, T12, T21, T22 which satisfies the equations (14) to (16), the reference current source according to the invention can thus be used to generate a reference current which is at least approximately constant within a given temperature interval.

Figure 5:
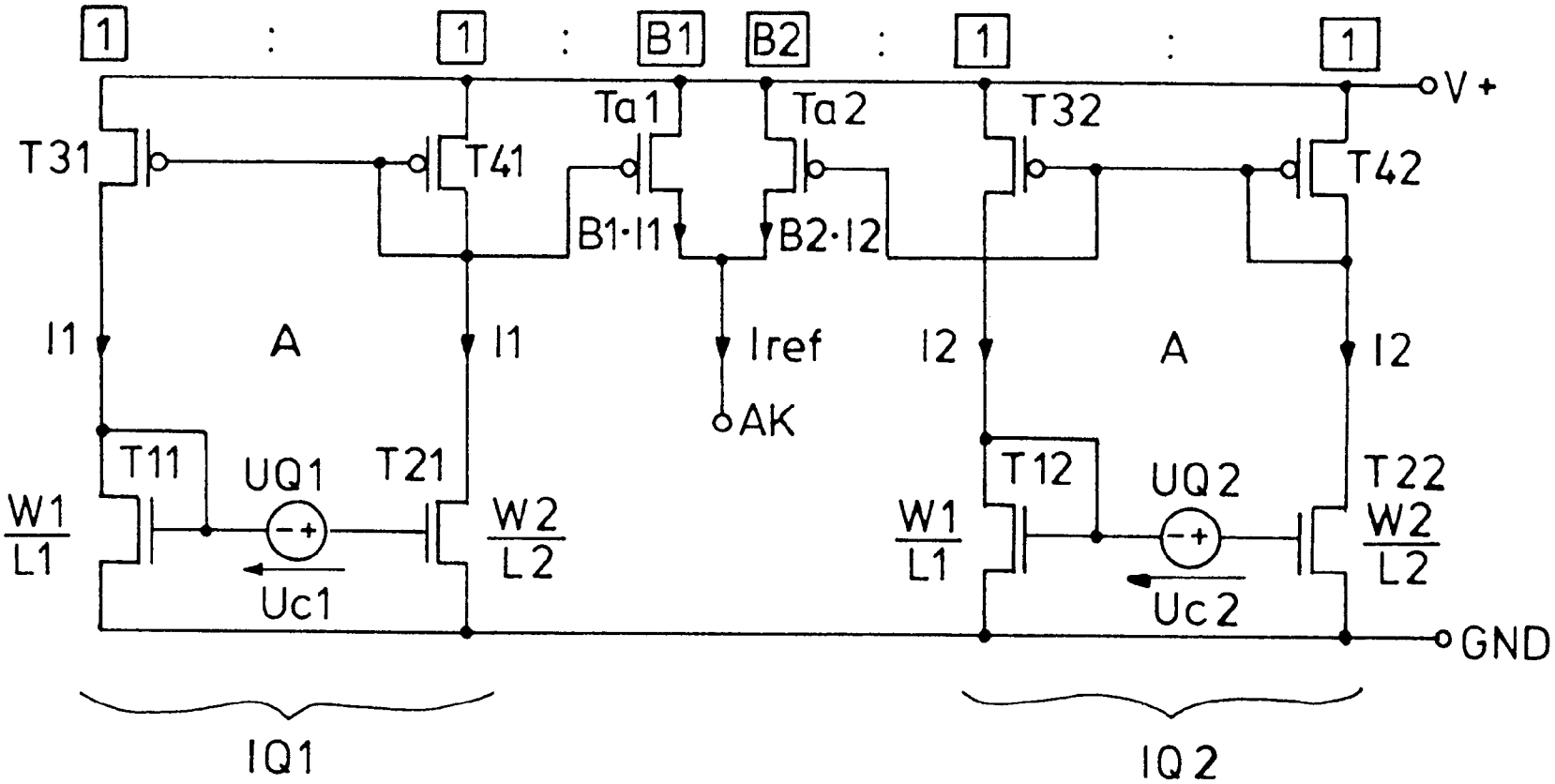
FIG. 5 shows a circuit diagram of a reference current source according to the invention in accordance with a further embodiment.

FIG. 5 shows a further exemplary embodiment of a reference current source according to the invention, in which the first transistors T11, T12 of the first and second current sources IQ1, IQ2 are each dimensioned identically (W1/L1) and in which the second transistors T21, T22 of the first and second current sources are each dimensioned identically (W2/L2).

In contrast to the embodiment according to FIG. 4, the output transistors Ta1, Ta2 in the reference current source according to FIG. 5 are dimensioned differently from the fourth transistors T41, T42 with which they form a respective current mirror. The current ratio of the first output transistor Ta1 and of the fourth transistor T41 of the first current source IQ1 for a given gate-source voltage is B1:1 and the current ratio of the second output transistor Ta2 and of the fourth transistor T42 of the second current source IQ2 is B2:1.

The following then holds true for the reference current Iref:

$$Iref=B1\cdot I1+B2\cdot I2=A\cdot B1\cdot K\cdot Uc1^2+A\cdot B2\cdot K\cdot Uc2^2 \tag{17}$$

The factor A, with the control voltages Uc1, Uc2, determines the basic current and the factors B1, B2 weight the currents II, I2 in a suitable manner. If the relationship A1/A2 in equations (14) to (16) is replaced by B1/B2 and the transistors T41, T42, Ta1, Ta2 are dimensioned in such a way that the ratio B1/B2 satisfies these equations, then this results in a likewise at least approximately temperature-independent reference current Iref.

In order to provide a better understanding, it shall be pointed out that A1 and B1 are greater than A2 and B2, respectively. For $\alpha$=1.5 and the special case of a constant second control voltage for Uc2, the ratio of A1/A2 is about 3, and about 9 for $\alpha$=1.8, For a control voltage which is inversely proportional to absolute temperature, a ratio for A1/A2 of between 14 and 38 results for a between 1.5 and 1.8 and a temperature coefficient TC2 of −2 mV/K.

Figure 6:
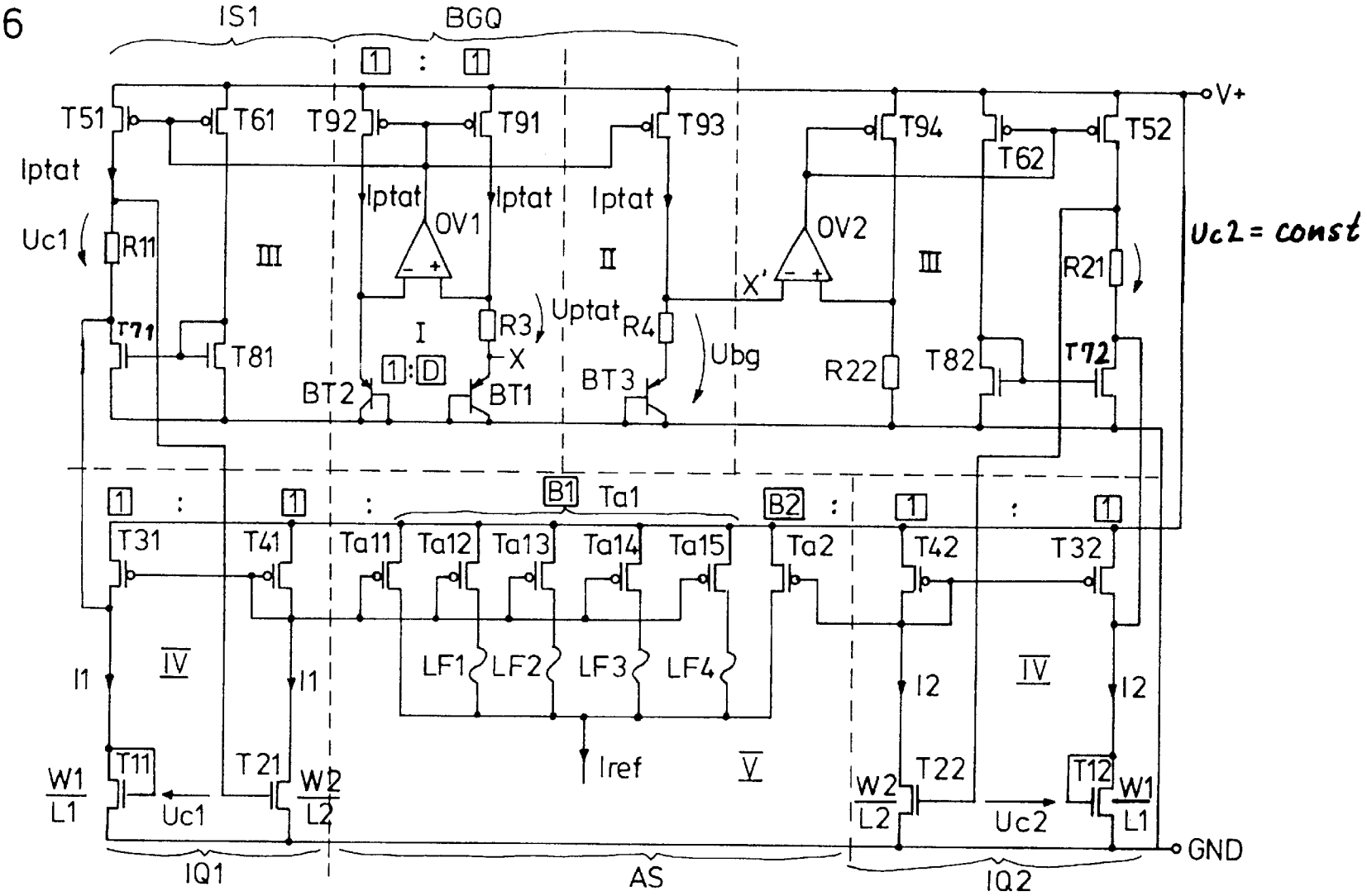
FIG. 6 shows an overall circuit diagram of a reference current source according to the invention.

FIG. 6 shows an overall circuit diagram of a reference current source according to the invention.

The reference current source has first and second voltage-controlled current sources IQ1, IQ2 and an output stage AS. In FIG. 6, the first output transistor Ta1 comprises a number of parallel transistors Ta11, Ta12, Ta13, Ta14, Ta15, some of which can be deactivated by series-connected laser fuses in order to be able to set the current ratio B1:1 of the first output transistor Ta1 and of the fourth transistor T41 of the first current source IQ1.

In order to provide the first and second control voltages Uc1, Uc2, a bandgap reference BGQ is provided, which has a first series circuit comprising a first bipolar transistor BT1, a resistor R3 and a MOS transistor T91 (p-channel transistor) and a second series circuit comprising a second bipolar transistor BT2 and a MOS transistor T92 (p-channel transistor), which are each connected up between the supply potential V+ and the reference-ground potential GND. A first input (non-inverting input) of an operational amplifier OV1 is connected to a node which is common to the resistor R3 and the MOS transistor T91, and a second input (inverting input) of the operational amplifier OV1 is connected to a node which is common to the second bipolar transistor BT2 and the MOS transistor T92, The gate terminals of the transistors T91, T92 are connected to an output of the operational amplifier OV1, The bipolar transistors BT1, BT2 are each connected up as diodes, that is to say their base and collector are each connected to reference-ground potential GND.

The current ratio of the first and second bipolar transistors BT1, BT2 is D:1. The operational amplifier OV1 drives the MOS transistors T91, T92 in such a way that the emitter currents Iptat of the bipolar transistors are identical in each case. The emitter currents Iptat are proportional to absolute temperature. The following holds true for a voltage Uptat brought about across the resistor R3 by the current Iptat:

$$Uptat = TC1 \cdot T = \frac{k \cdot T}{q} \cdot In(D) \tag{18}$$

where k is Boltzmann's constant and q is the elementary charge.

The reference current source furthermore has a first current mirror arrangement IS1 having a series circuit comprising a transistor T51 and a transistor T71 and a series circuit comprising a transistor T61 and a transistor T81 in each case between the supply potential V+ and the reference-ground potential GND. Connected up between the transistors T51, T71 is a resistor R11 which is connected to the gate terminals of the first and second transistors T11, T21 of the first current source IQ1 and whose resistance corresponds to that of the resistor R3 or is a multiple thereof. The method of operation of the current mirror T51, T61, T71, T81 corresponds to that of the current mirror of the transistors T7, T6, T9, T8 in accordance with FIG. 3. It transfers the temperature-dependent voltage Uptat across the resistor R3, or a multiple thereof, to the resistor R11 between the gate terminals of the transistors T11, T21 of the first current source IQ1. In this case, Uc1=Uptat·R11/R3 holds true for the voltage across this resistor, and the ratio of the resistors R11 and R3 thus determines the factor with which the voltage Uptat across the resistor R3 is transferred to the voltage Uc1 across the resistor R11.

The bandgap reference BG and the current bearer IS1 provide a temperature-dependent voltage Uc1 for the transistors T11, T21 in a manner that is simple to realize. In this case, the bipolar transistors BT1, BT2 can be realized as parasitic transistors in a CMOS circuit. The resistors R11, R3 may be temperature-dependent but should have the same temperature dependence. Such resistors are simple to realize in CMOS processes.

In order to provide a constant second control voltage Uc2, provision is made of a further series circuit comprising a MOS transistor T93, a further resistor R4 and a further bipolar transistor BT3 between supply potential V+ and reference-ground potential GND. The resistor R4 is preferably larger than the resistor R3, The MOS transistor T93 is likewise driven by the operational amplifier OV1, The MOS transistor T93 effects a current flow through the resistor R4 and the bipolar transistor BT3 which corresponds to the temperature-dependent current Iptat through the first and second bipolar transistors BT1, BT2, The sum of the voltage Ubg brought about by this current Iptat is essentially constant in a temperature-independent manner. This voltage Ubg, referred to reference-ground potential, across the resistor R4 and the bipolar transistor BT3 is transformed, by means of a circuit arrangement having an operational amplifier OV2, a series circuit comprising a MOS transistor T94 and a resistor R22 and a current mirror T52, T62, T72, T82, into a voltage between the gate terminals of the first and second transistors T21, T22 of the second current source IQ2, This circuit arrangement corresponds to a floating voltage source whose construction and method of operation correspond to the circuit arrangement according to FIG. 3 for converting the voltage Uc with respect to reference-ground potential into the voltage Uc between the gate terminals of the transistors T1, T2, In this case, the gate terminals of the transistors T12, T21 of the second current source IQ2 are connected to a resistor R21 between the transistors T52, T72 of the current mirror.

If, in the reference current source according to FIG. 6, the series circuit comprising the MOS transistor T93, the resistor R4 and the bipolar transistor BT3 is dispensed with and the inverting input (circuit point x') of the operational amplifier OV2 is connected directly to the common node of the first bipolar transistor BT1 and of the resistor R3 (circuit point x), then a second control voltage Uc2 which is inversely proportional to absolute temperature is obtained.

As has been shown, the reference current source according to the invention supplies a current that is at least approximately constant in a temperature interval. Furthermore, the reference current source can easily be integrated into CMOS technology.

Whereas, with reference to the above exemplary embodiments, only dimensioning specifications for the first and second MOS transistors of the first and second current sources were derived, in order to arrive at a reference current compensated with respect to first-order temperature-dependent terms, it is possible, by means of further voltage-controlled current sources, to generate a reference current which is also compensated with respect to higher-order temperature dependencies.

I claim:

1. A reference current source, comprising:

at least one first voltage-controlled current source including:

at least one first control voltage source providing a first temperature-dependent control voltage, at least one first MOS transistor having a process gain, and an output providing a first current that is dependent on the control voltage and on the process gain of said first MOS transistor;

at least one second voltage-controlled current source including:

at least one second control voltage source providing a second control voltage, at least one second MOS transistor having a process gain, and an output providing a second current that is dependent on the second control voltage and on the process gain of said second MOS transistor; and an addition unit for providing a reference current from the first current and the second current.

2. The current source according to claim 1, wherein a derivative of the first control voltage with respect to temperature is different than a derivative of the second control voltage with respect to temperature.

3. The current source according to claim 2, wherein the second control voltage is constant.

4. The current source according to claim 1, wherein the first control voltage is proportional to absolute temperature.

5. The current source according to claim 4, wherein the second control voltage is inversely proportional to absolute temperature.

6. The current source according to claim 1, comprising:

a supply potential and a reference-ground potential;

said at least one first MOS transistor of said first voltage-controlled current source defining at least two MOS transistors having load paths connected between said supply potential and said reference-ground potential;

said MOS-transistors of said first voltage-controlled current source having control terminals coupled to one another;

said at least one second MOS transistor of said second voltage-controlled current source defining at least two MOS transistors having load paths connected between said supply potential and said reference-ground potential; and said MOS-transistors of said second voltage-controlled current source having control terminals coupled to one another.

7. The current source according to claim 6, wherein:

said first control voltage source is connected between said control terminals of said MOS transistors of said first voltage-controlled current source; and said second control voltage source is connected between said control terminals of said MOS transistors of said second voltage-controlled current source.

8. The current source according to claim 7, wherein:

one of said MOS transistors of said first voltage-controlled current source and one of said MOS transistors of said second voltage-controlled current source are dimensioned identically; and another one of said MOS transistors of said first voltage-controlled current source and another one of said MOS transistors of said second voltage-controlled current source are dimensioned identically.

9. The current source according to claim 1, wherein:

said addition unit weights the first current with a first weighting factor B1 and weights the second current with a second weighting factor B2 prior to adding the first current and the second current.

10. The current source according to claim 9, wherein:

a ratio of the first weighting factor B1 and the second weighting factor B2 satisfies a relationship:

$$B1/B2=\alpha\cdot(Uc2(T_R))^2-2\cdot Uc2(T_R)\cdot T_R\cdot TC2/(2-\alpha)\cdot(Uc1(T_R))^2,$$

where $\alpha$ is a quantity dependent on a method for fabricating the at least one first MOS transistor and the at least one second MOS transistor, Uc1 ($T_R$) is a value of the first control voltage at a reference temperature $T_R$, Uc2 ($T_R$) is a value of the second control voltage at the reference temperature $T_R$, and TC2 is a temperature coefficient of the second control voltage.

11. The current source according to claim 1, comprising a bandgap reference for providing the first control voltage and the second control voltage.

* * * * *